US007516943B1

(12) United States Patent
Haut

(10) Patent No.: US 7,516,943 B1
(45) Date of Patent: Apr. 14, 2009

(54) CROOK COMPENSATION DEVICE

(75) Inventor: Dale Steven Haut, New Berlin, WI (US)

(73) Assignee: Dale S. Haut, New Berlin, WI (US)

( * ) Notice: Subject to any disclaimer, the term of this patent is extended or adjusted under 35 U.S.C. 154(b) by 0 days.

(21) Appl. No.: 11/899,580

(22) Filed: Sep. 7, 2007

(51) Int. Cl.
*B66F 3/00* (2006.01)

(52) U.S. Cl. ..... 254/17; 254/131; 254/25; 52/747.1

(58) Field of Classification Search ..... 254/17, 254/11, 120, 113, 131, 21, 25; 52/747.1, 52/749.1
See application file for complete search history.

(56) References Cited

U.S. PATENT DOCUMENTS 354,418 A * 12/1886 Hill ..... 254/17
4,821,784 A * 4/1989 Cone ..... 144/381
5,269,494 A * 12/1993 Pittman et al. ..... 254/17
5,478,050 A * 12/1995 Ott ..... 254/17
5,605,319 A * 2/1997 Reiley ..... 254/17
5,894,705 A * 4/1999 Sutton ..... 52/747.1

* cited by examiner

*Primary Examiner*—Lee D Wilson

(57) ABSTRACT

This invention consists of a hand operated tool to be used for the purpose of forcibly straightening or positioning material such as outdoor deck boards, tongue and groove wall or ceiling boards, tongue and groove interior wood flooring and other similar wood or composite construction material. It includes an elongated handle with a spoked circular plate attached to one end. The plate has a means of attachment to the framing or sub floor which allows the tool to pivot on an off-center point. Swinging the handle in an arc thereby rotating the circular plate gradually increases the radius from the fixed pivot point to the outer edge of the disk which forces the wood in the desired direction, thereby straightening it.

8 Claims, 9 Drawing Sheets

1
2
3
4
26
29
30

8
9
10
10
2

3
11

FIG. 19
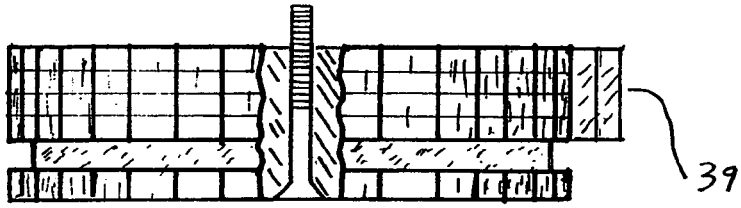
FIG. 20
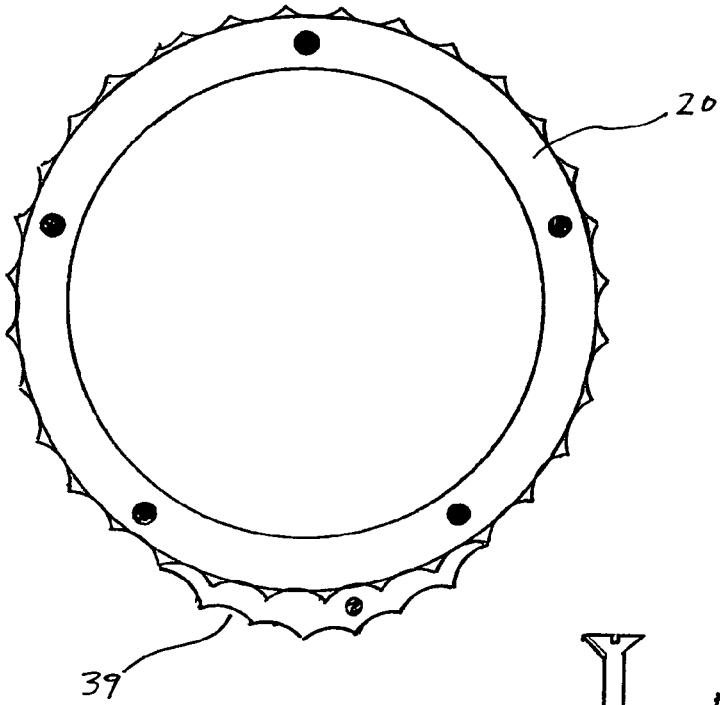
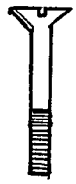
FIG. 22
FIG. 21
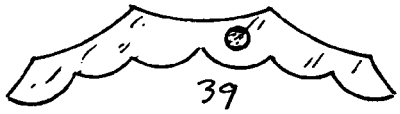

FIG. 23
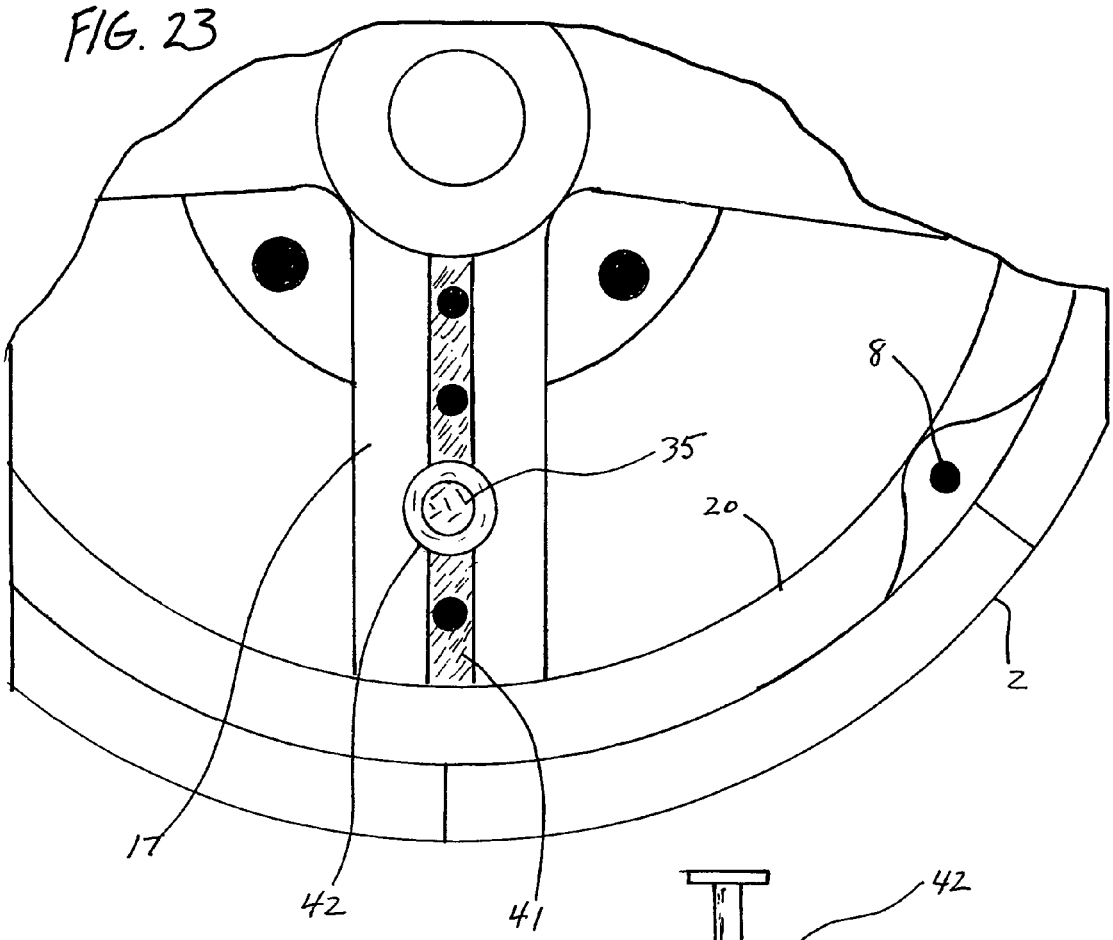
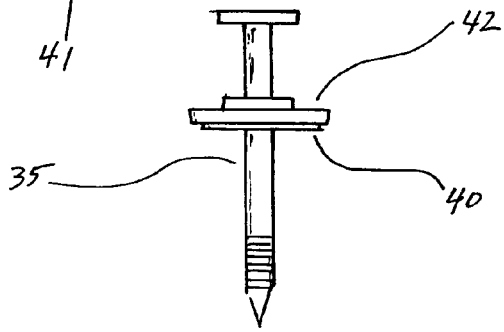
FIG. 24

CROOK COMPENSATION DEVICE

BACKGROUND OF THE INVENTION

Wood and composite material is often not straight, and to fasten the material to the sub-structure it is necessary to first push it into a straight position. This can be difficult due to the internal strength of the wood. This new crook compensation device is designed to easily force material into a straight line so it can be securely fastened down thus remaining in the corrected position. This tool is designed to be used with outdoor deck boards, tongue and groove wall or ceiling boards, exterior siding, and interior tongue and groove solid wood flooring as well as other similar materials. The word material shall be used throughout as a single word to define the above mention materials. The mode of operation of this improved tool in simplistic terms is through the use of a straight lever attached to a circular disk that is rotated on an off center axis pivot point, thereby causing a cam type movement. This pivot is securely fastened to the underlying structure using either of the two methods described within, with the edge of the disk closest to the pivot point touching the material to be straightened. The radial increase in the distance from the purposely off center pivot point to the edge of the disk as the tool is rotated, causes the material to be pushed in a lateral direction.

There are many devices shown in prior art using a variety of methods to force crooked wood into position to then be securely fastened in place. There are also a variety of methods used to accomplish the same purpose using tools not intended for such a task, thereby being somewhat dangerous, slow and can damage the material being installed. It is the intent of this invention to provide a tool with improvements to the methods used by the numerous prior art, for the purpose of straightening material. These improvements make it more versatile, effective, and easy to use. This tool would be primarily made of a cast metal, aluminum being preferred, and some parts would be machined steel. Hard rubber is a consideration for certain appropriate parts.

As stated, there are numerous devices in prior art. U.S. Class 254/15 and U.S class 254/17 total 37 patents per the applicants search of the USPTO records. Of these, the following three examples are known to this applicant as being available to the public for purchase, though there may be others. U.S. Pat. Nos. 6,962,179, 5,248,127, and D353,987.

Some examples of particular interest in the numerous prior art are as follows.

U.S. Pat. No. 5,478,050 to Ott, U.S. Pat. No. 5,605,319 to Reily, and U.S. Pat. No. 5,269,495 to Pittman. These examples use a rotational cam or circular plate with a long handle and a single, fixed, off center pivot point as the basic means to force the material into place. As shown in the body of this application, this invention disclosed will use multiple pivot points for a specific purpose as stated within. Also, referring to these examples, they use a similar (to each other) fixed means as shown in the patent to attach the tool to the wood joist below, limiting the tool so it cannot be used over obstructions in the framing or on plywood or similar flat surfaces. This invention as disclosed addresses that issue by using an easy to remove lower assembly. It should also be noted that U.S. Pat. No. 5,964,450 to Pasto addresses the need to push tongue and groove flooring into position when being installed over plywood, as does the invention disclosed. The previously mentioned patents are not for use in this situation. It is the intention of this present invention as disclosed, to have a crook compensation device for tongue and groove flooring that is easier to use and more cost effective.

Continuing reference to these examples: only U.S. Pat. No. 5,605,319 to Reily clearly discloses an actual method of stopping the rotation of the tool in any position, without the need to reposition the tool, so it can be released, allowing the user to have both hands free to secure the material to the sub-structure; an important consideration. This invention uses a new and effective way to lock the rotation in any position between its minimum and maximum capacity. Again, there are numerous examples of prior art using methods to move crooked wood, ranging from very complicated, thereby being costly to make, to very basic lever type devices which would lack features needed to make it worthy of the various conditions one may encounter. It is the intention of this invention to provide a better way to accomplish the often needed task of installing crooked wood and wood like materials.

SUMMARY OF THE INVENTION

It is the intention of this invention to provide a means to forcibly remove the crook found in many forms of wood and even synthetic composite decking and siding material, using a new and improved tool over the prior art, so the material can be fastened in its corrected position. There are many terms to describe wood that is not straight. A crook describes the bend of a board when the plane of the face of the board remains straight, but the ends and middle do not make a straight line. This is a common condition found in much of the material used today. For the purpose of this summary and throughout, the words bent, crook, crooked, and warped will refer to the same undesirable condition of wood for which this invention is intended to correct. The purpose of bending these boards back to a straight position is obvious, almost all installation of finished wood materials require it to be straight. (However, if one would like to bend a straight board to give the wood a bent look, this tool can do that to.) This tool embodies improvements which will be spelled out in more detail in the description. In brief, they are as follows. A crook compensation device with multiple pivot point holes around the disc which allow the user to choose a comfortable position to work with the tool. It can be used to push the material away from the user, or push the material towards the user without a change in the overall feel of the tool. A device that can be used on any sub-structure. A crook compensation tool in its basic form that can be swung with one motion to push the material and hold its position without manual assistance or the need of a lock at any point between ¼" to approx. 2.5" of lateral movement due to the use of a disk edge with raised ridges. A crook compensation device that when used with the joist adaptable roller plate described within the details of FIG. 14, can be locked in any position from ¼" to 2.5 " of lateral movement and held without manual assistance. A new way to lock the rotating disk, when used with or without the roller plate assembly, with a lock lever using the same principle as the main tool, an off center axis, circular disk, and a lever. And a fast, tool-less way to remove the lock lever and the roller plate assembly so the tool can be used above framing obstructions such as blocking or double joists or plywood. A new device with a purposeful handle design that provides balance, leverage and safety, as well as a location for a gap gauge that is used to quickly determine the gap to be closed. And a board straightening tool that has a new way of automatically locking the tool to the underlying joist without the need for clamps, nails, spikes or hammers, when used as shown in its entirety as in FIG. 1 or FIG. 15. This crook compensation device solves the problem of straightening and positioning wood to prepare it for securing in a way that is effective, easy to use, adaptable to multiple situations and on a variety of substructures. In its basic form (without the joist locking device of FIG. 15) it has no moving parts.

BRIEF DESCRIPTION OF DRAWINGS

FIG. 19 Side view of disk assembly showing attached range cam 39.

FIG. 20 Top view of outer ring with range cam 39 attached

FIG. 21 Range cam 39

FIG. 22 Range cam attaching screw

FIG. 23 Cut view of 1 plate spoke (FIG. 7) with washer magnet 42 nail 35 and magnetic strip 41

FIG. 24 Nail with magnet and washer

DETAILED DESCRIPTION OF THE INVENTION

The following detailed description pertains to the invention disclosed and indicates the features that are new. This tool is for the purpose of aiding the user in removing the crook in wood or composite material in the form of deck planks, tongue and groove flooring or wall planks, and similar material so it can be fastened in a straight position. The following will describe the best way to carry out this procedure.

Figures 1, 2, 3, 4, 5, 6:
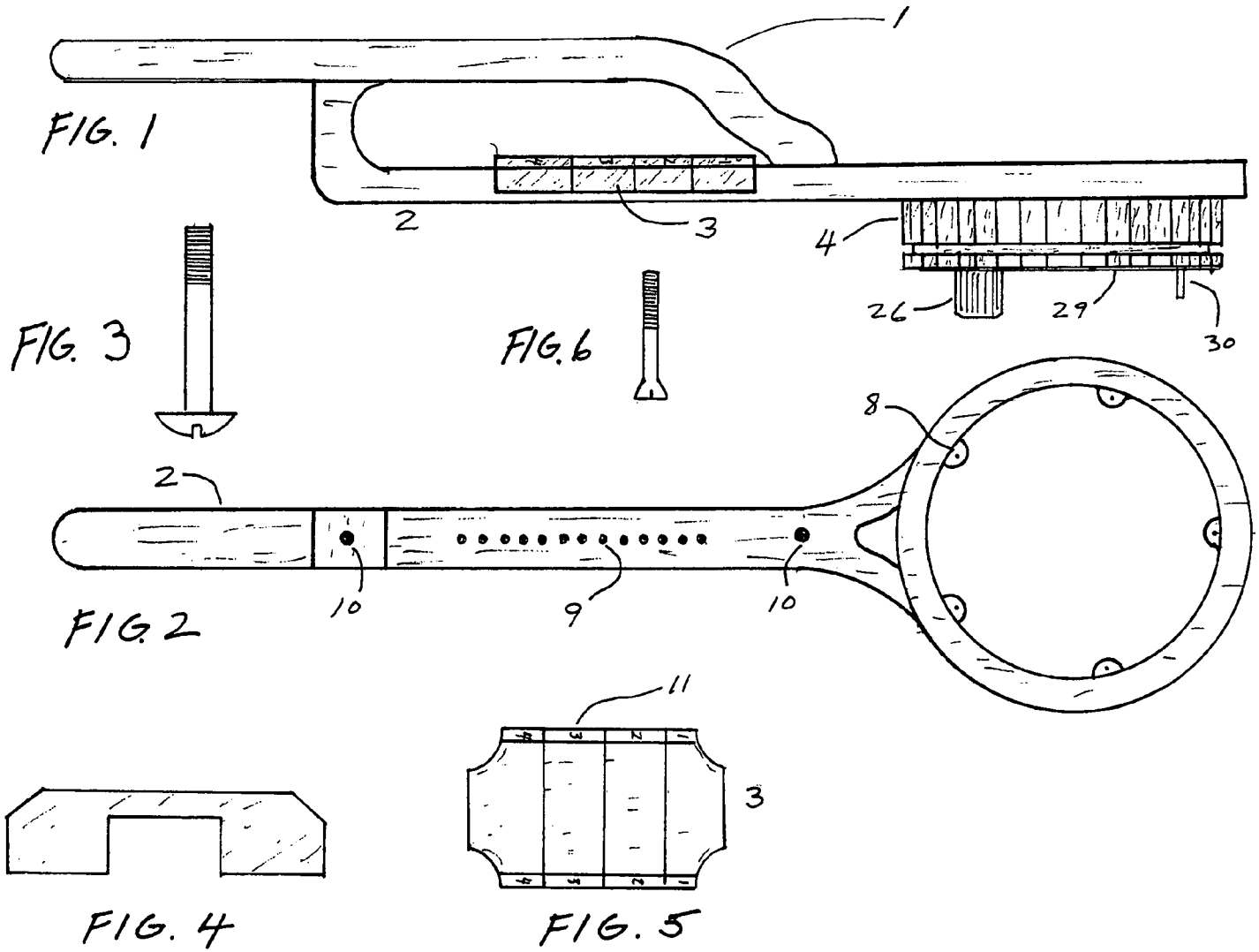
FIG. 1 Side view of the entire tool including the upper and lower handles, the disk assembly, and the gap gauge.
FIG. 2 Top view of the lower handle and the integral disk attachment ring.
FIG. 3 One of the two bolts that connect the upper and lower handle.
FIG. 4 End view of the gap gauge.
FIG. 5 Top view of the gap gauge.
FIG. 6 Screw to secure the gap gauge to the lower handle

FIG. 1 of the drawings is a side view of the tool showing the upper handle 1, lower handle and integral disk ring 2, gap gauge 3, disk assembly 4, pin 30, roller 26 and roller plate 29, and it will be considered to make up the entire tool. References made throughout this description to "the tool" as a whole unit may be referred to as FIG. 1.

FIG. 2 is a top view of the lower handle 2 with its integral disk attaching ring. The five threaded protrusions 8 found on the inside of the ring will receive the screws that secure the disk assembly 4 to the lower handle 2. Multiple holes 9 are to allow various positioning of the gap gauge (FIG. 5). Holes 10 are to receive bolts (FIG. 3) to attach the upper and lower handle together.

FIG. 3 is one of the two bolts needed to attach the lower handle 2 to the upper handle 1. These bolts pass through the holes 10 (FIG. 2) in the lower handle 2 to attach to the upper handle 1 of FIG. 1.

FIG. 4 is an end view of the gap gauge.

FIG. 5 is a top view of a multi-positional gap gauge which allows the user to set the gauge one time at the beginning of the project, to the exact width of the material to be used. The mode to carry out using the gauge after it has been set, is to hold the disk of the tool of FIG. 1 against the crooked board with the handle perpendicular to the edge of the board to be moved into position, then read the number 11 on the gauge that aligns with the edge of the already secured material. The multiple small holes in the lower disk plate (FIG. 7) have corresponding numbers 12. The user places the pivot nail in that hole, secures the nail to the substructure and rotates the tool FIG. 1, thereby closing the gap and allowing the tool to be self maintained in a locked position. It should be understood according to these drawings, this gauge is not needed when the roller plate assembly 26 and 29 is attached, though this does not limit the possibility for such a configuration. Further description of the use of the gauge will follow in FIG. 16.

FIG. 6 is a screw to hold FIG. 5 to the lower handle 2.

Figure 7:
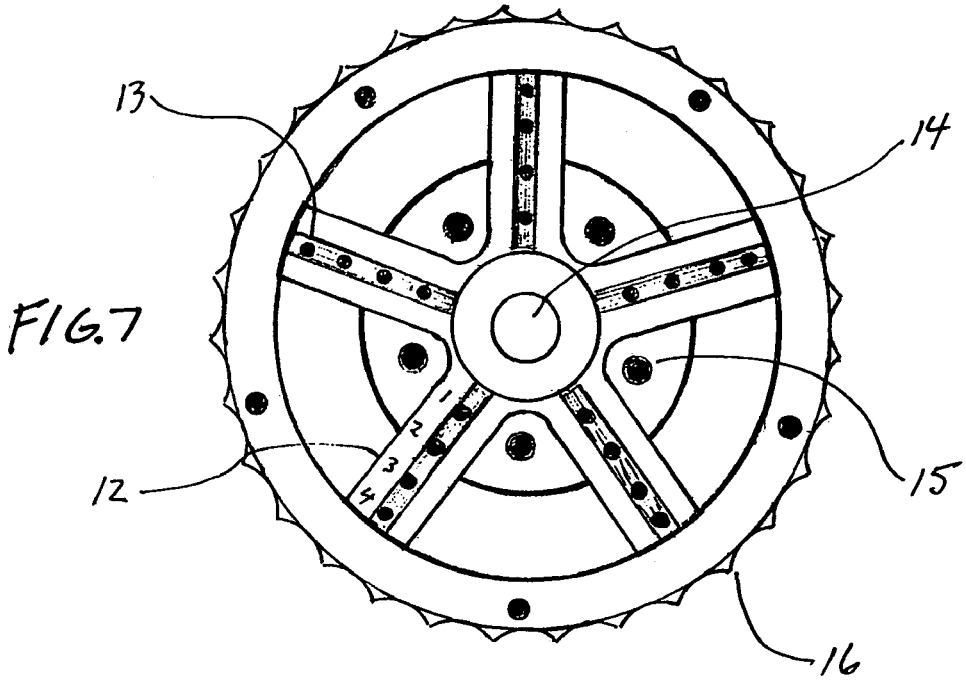
FIG. 7 Top view of the lower disk plate

FIG. 7 is a top view of the lower disk plate. It is made up of a circular metal disk with multiple holes 13 radiating out from the center of the disk. These holes are found in each of the five spokes, allowing the user to choose a comfortable starting point of the tool. Also, as the individual hole 13 increases distance from the true hub center 14 of the disk, the rotation of the tool assembly in either direction will close increasingly larger gaps between the boards since the distance of the pivot point from the starting edge of the disk, which is placed against the material, is 180 degrees opposite of the ending position. The distance between the pivot point and the closest and furthest edge from that point determines the total gap closed. Further found on figure 7 is the larger holes 15. They are to receive pin 24 attached to the roller plate which will be described in FIGS. 13 and 14.

The ridges 16 found on the disk of FIG. 7 are there to provide a better hold between the disk and the material to be positioned. Ridges 16 are equally spaced and would have a ridge peak that is generally flat as opposed to coming to a sharp point.

Figure 8:
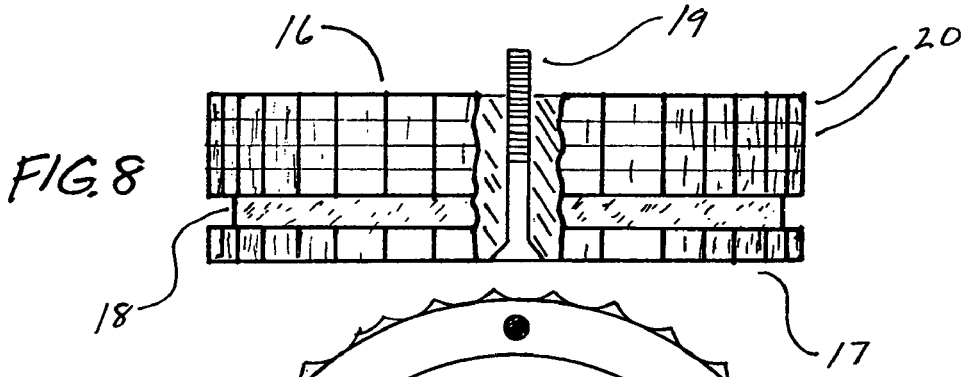
FIG. 8 Side view of disk assembly (with partial cut out) showing the lower disk plate and several outer rings FIG. 9 Top view of outer rings FIG. 10 Edge view of lock key FIG. 11 Cross section of one roller FIG. 12 Clevis pin with angled slot for quick removal of lock key of FIG. 10

FIG. 8 is a side view (with a partial cut out) of the disk assembly of FIG. 1 reference 4 with its various individual parts described in detail. Lower disk plate 17 includes all the details shown in FIG. 7. Plate 17 may also have the rabbet 18 for use with tongue and groove material. Screw 19 in multiples will attach the disk assembly to the tabs found in FIG. 2, ref. 8.

Figure 9:
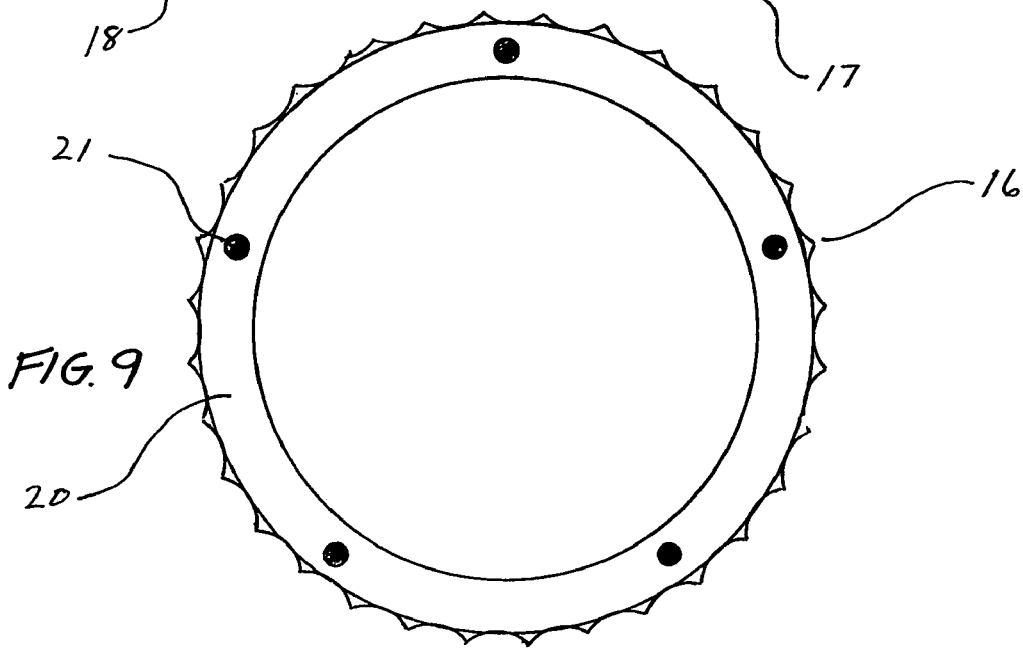

FIG. 9 is a top view of one of several rings 20. These rings are approximately ⅛" thick and are changeable for different material thickness by removing screws 19. The optimum performance of the tool is achieved when the disk assembly measures a thickness that is slightly more than the wood material. Holes 21 will allow insertion of screws 19. These rings have the ridges 16 as described in details of FIG. 7.

Figure 10:
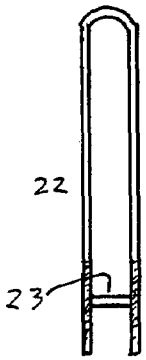
Figure 13:
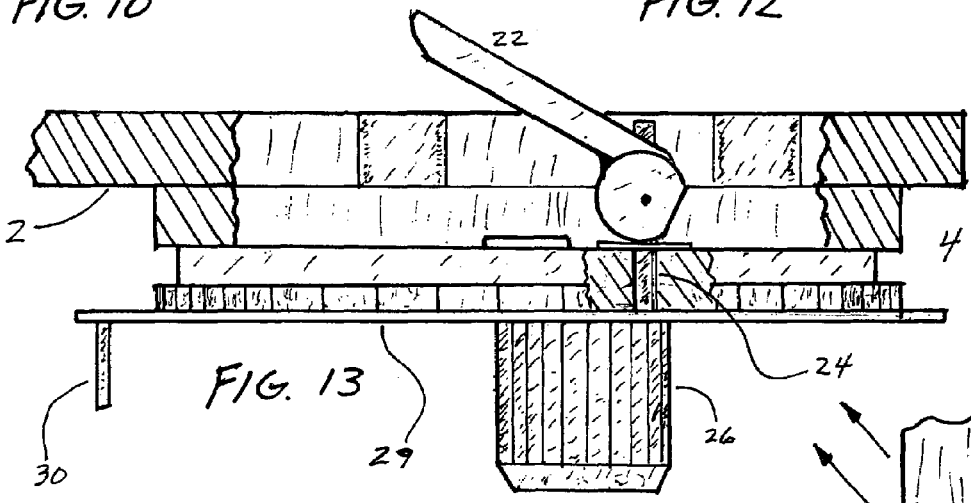
FIG. 13 Side view of the lower handle, disk plate, outer rings, roller plate and roller, and the lock key. The lower handle and integral disk attaching ring of FIG. 2 and the rings of FIG. 9 have been sectioned to show the lock key in position.
Figure 14:
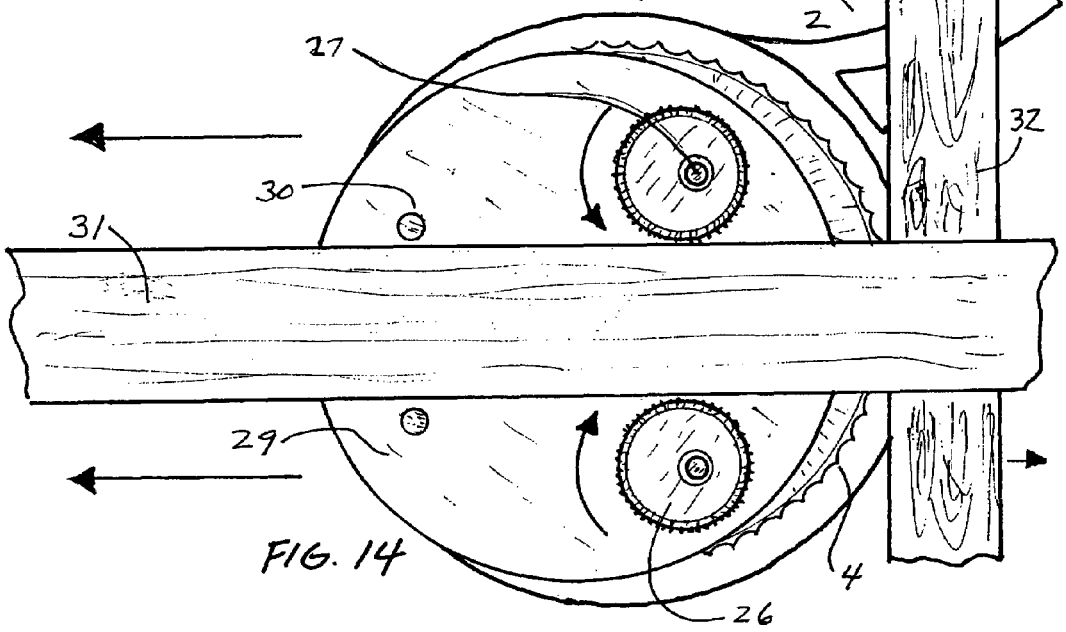
FIG. 14 Bottom view of rollers and roller plate shown in use.

FIG. 10 is a front view of the lock key 22 used in conjunction with the roller plate assembly of FIGS. 13 and 14. This lock key uses the same principle of the disk assembly 4 as described in FIG. 7 in regards to the cam effect an off center pivot point of a circle. The pin 23 of lock key 22 slides into the angled slot 25 of the clevis pin 24. As shown in FIG. 13, lock key 22 is in a locked position thereby creating a force that pulls disk assembly 4 tightly to the roller plate assembly of FIGS. 13 and 14. This force holds the tool from rotating in an opposite direction of the pull of the handle, thereby allowing a self-maintained condition.

Figure 11:
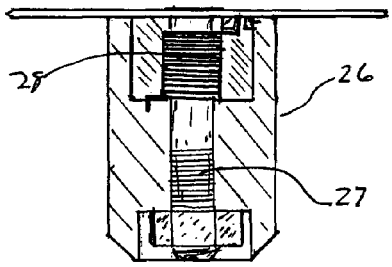

FIG. 11 is a cross section of one of two roller assemblies. It is made up of several parts and described as follows. The function of FIG. 11 will be described with FIG. 14. Reference 26 is the outer case of the roller. Not shown with case 26 is the substantially rough or ridged surface. The roller rotates around bolt or pin 27, with the appropriate securing member in relation to the bolt or pin. Reference 28 indicates a torsion type spring that returns the roller to a pre-set position as described in FIG. 14

Figure 12:
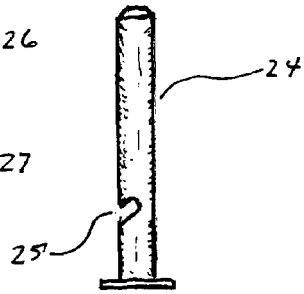

FIG. 12 is the clevis pin 24 as mentioned above. The angled slot 25 allows quick removal of the lock key 22. The pin 24 is secured to the roller plate 29 in a permanent fashion.

FIG. 13 is a detailed cut away view of the roller plate 29, roller 26, lock key 22, plate assembly 4 and partial handle 2. This view is to show the lock key 22 in use and how it relates to the other parts. The clevis pin 24 passes through any one of the holes 15 found in FIG. 7.

FIG. 14 Is a view from the bottom including the 1½" joist member 31 and the plank 32 to be straightened. Joist member 31 is an edge view. For the purpose of this drawing, plank 32 is not intended to be in the same scale as the tool. FIG. 14 is to show the function of the roller plate assembly which is made up of two rollers 26, roller plate 29, clevis pin 24 and stop pins 30. As the tools handle is pulled in either direction, the rotation of disk plates 4 against the wood 32 causes a slight backward and rotating motion of the roller assembly which is attached to the disk/handle assembly with clevis pin 24 and held in place by lock key 22. This rotation is held by the stop pins 30 as they contact joist 31.

Rollers 26 are now held against joist 31 by spring pressure using spring 28. The movement in the direction of the arrows shown causes the rollers which are not pivoting on a true center axis, to move in the rotational direction as shown by arrows in FIG. 14. This rotation causes a cam effect with the rollers 26 causing them to pinch the joist 31 and hold the roller assembly from moving back away from the plank, thereby allowing the tool to function as described to straighten crooked material.

Figure 15:
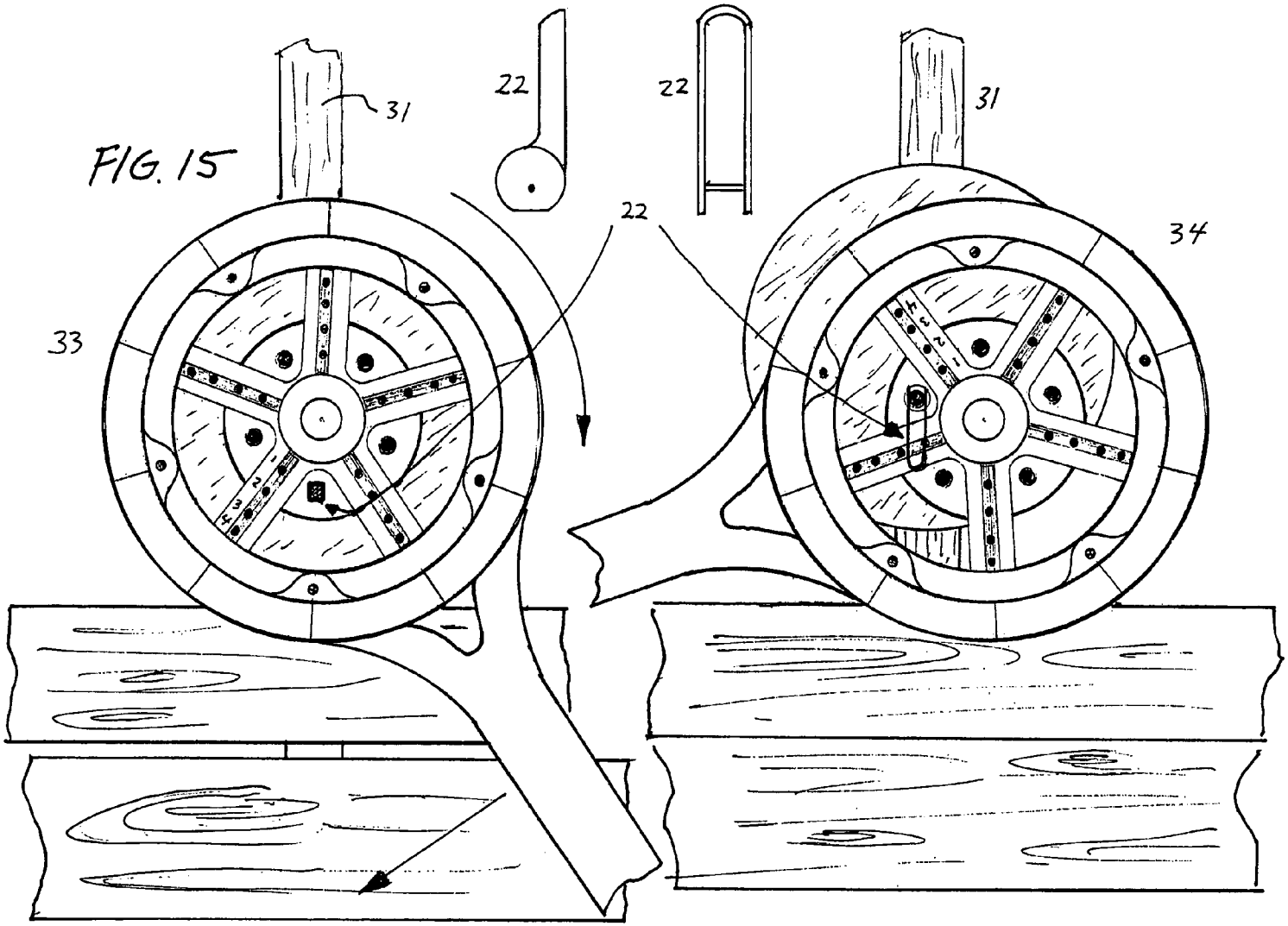
FIG. 15 Shows the general operation of the tool with the attached roller plate assembly and the lock key.

FIG. 15 shows the tool described within, being used to close a gap between two adjacent planks. This figure shows the use of the roller plate 29 and locking pin 22. Reference 33 of FIG. 15 depicts the tool in its start position. The pivot point is set at a point closest to the material to be pushed. The lock pin 22 is in an upright position. The handle is pulled in either direction (FIG. 33 shows clock-wise rotation) When the gap is closed as in ref. 34 the lock key 22 is pushed or pulled down to lock the tool in its final position to allow the user to release the handle and use both hands to secure the plank 32 with either a screw or nail. The lock key will not always be needed since the ridges 16 of FIG. 7 are designed to provide a firm hold.

Figure 16:
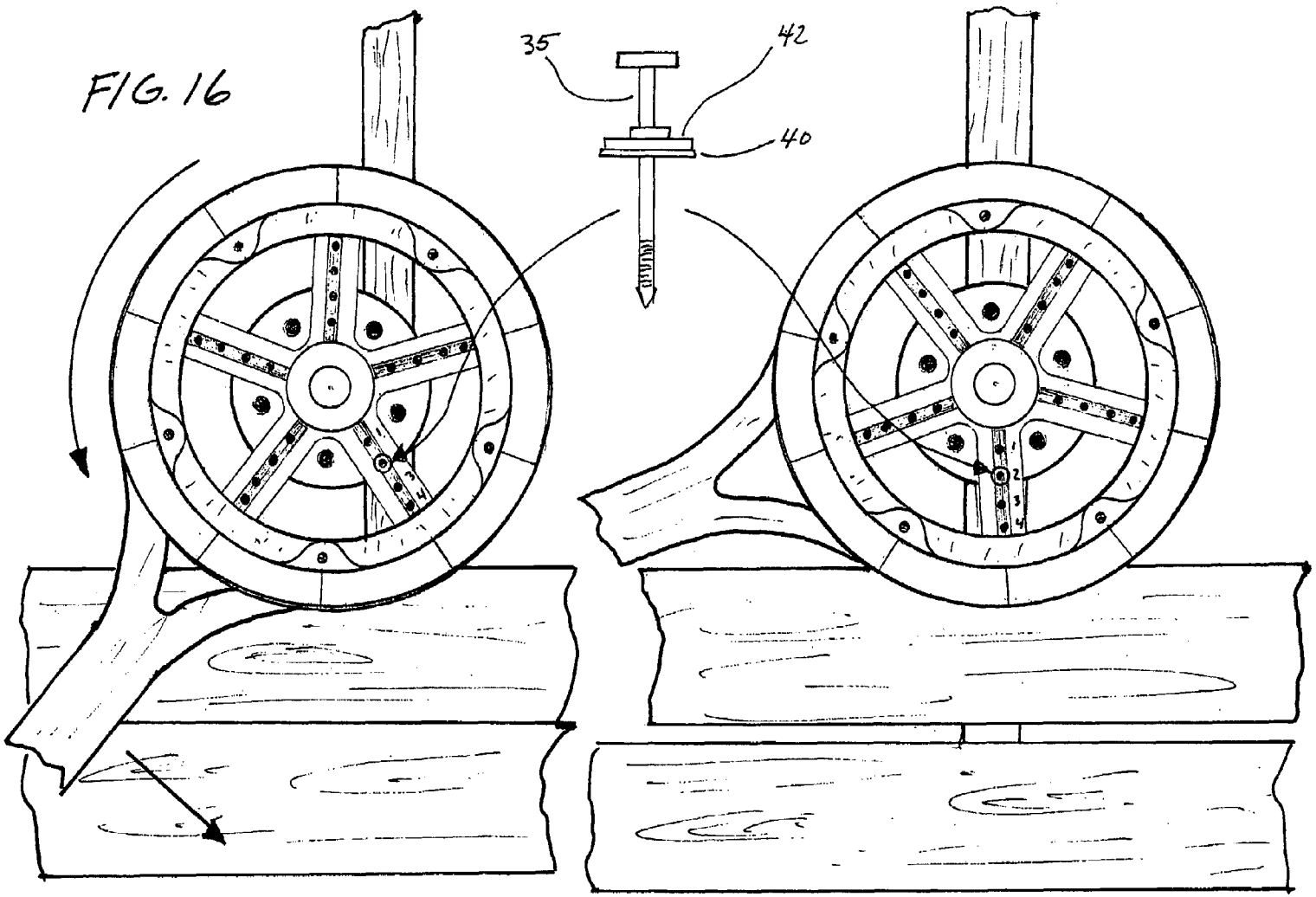
FIG. 16 Shows the general operation of the tool with the roller plate assembly removed using a nail as a pivot point.

FIG. 16 shows the tool described within, being used to close a gap between two adjacent planks as in FIG. 15. However, FIG. 16 uses a nail as the pivot point. The hole used is based on the gap between the boards as described within the description of FIG. 5 and FIG. 7. It should be noted the tool is designed to close gaps from zero to approx. three and one half inches, though it can close a gap of zero to 2" from one hole position, thereby eliminating the need to check the gap on every procedure, thus saving time. Nail 35 is secured to the plywood or frame style sub-structure using a hammer, the tool is pivoted to straighten the plank, the handle is released, the plank is secured, and the nail is removed with a hammer claw, or the tool can be lifted by the handle to pull the nail.

Figures 17, 18:
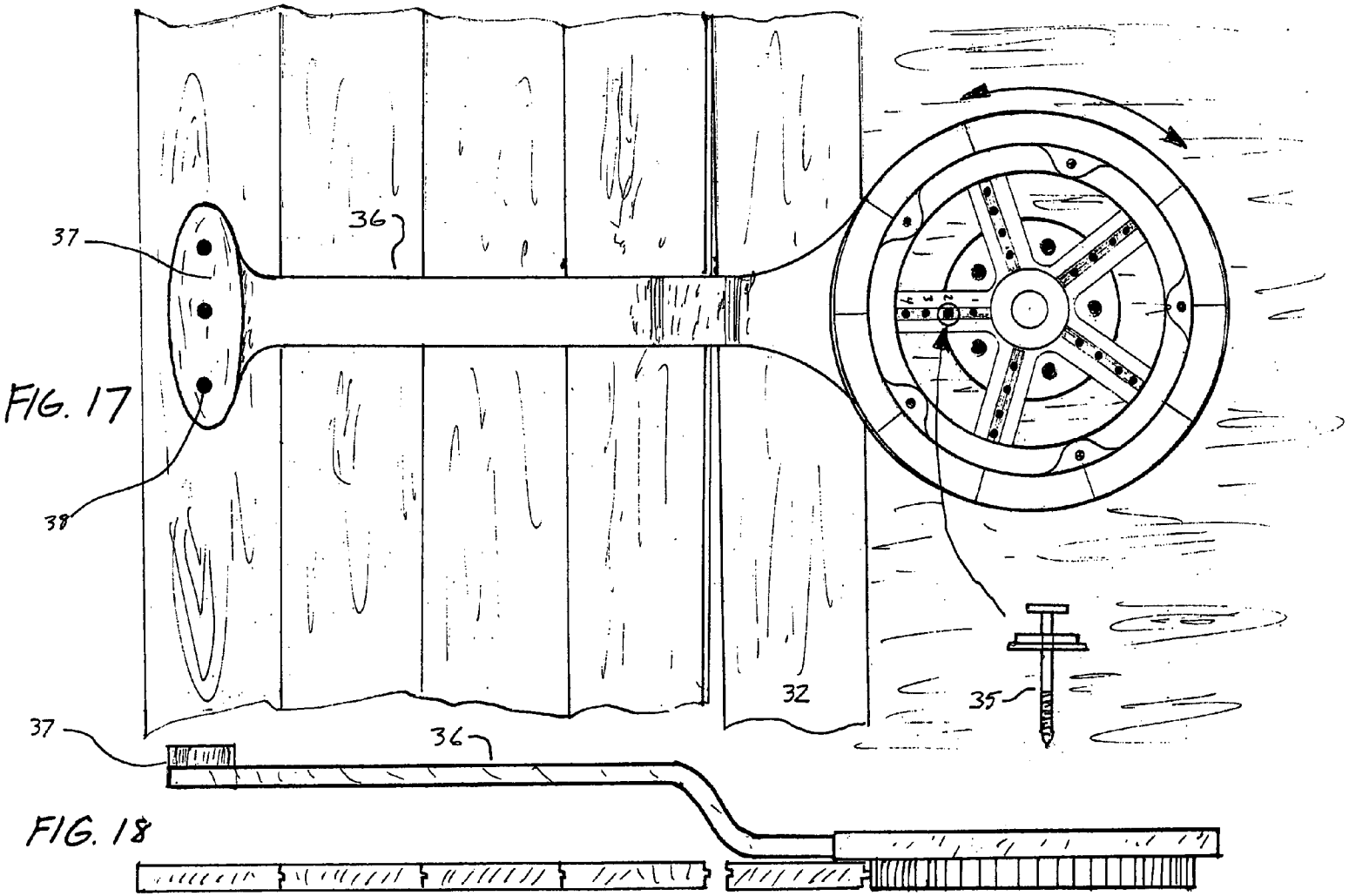
FIG. 17 Shows the operation of the tool on plywood using a nail as a pivot point with the alternate handle used for flooring or walls.
FIG. 18 Side view of the alternate handle

FIG. 17 and FIG. 18 shows the tool as described with an optional handle to be used for installation of interior tongue and groove floors or similar material. Since the main function of the tool has been described within, it will only be necessary to describe the handle. The handle 36 is formed as shown to allow either end of the tool to be hammered to the sub-floor. The elliptical cam 37 on the tools end is to be used in close proximity to a wall. It is used with nail 35 as well. The tool would be turned around (from how it is shown in FIG. 17) with the elliptical cam 37 placed against the board to be pushed. The three holes 38 are to accept nail 35 to allow the tool to pivot, thereby pushing the wood plank 32, yet allow minimal clearance between the wall and the cam 37.

FIG. 19 is a side view of the disk assembly 4 with the range cam 39 attached FIG. 20 is a top view of the outer ring 20 with range cam 39 attached. The function of range cam 39 can best be understood when view from the top. This cam would be attached at the beginning of the project, and is particularly adapted to outdoor deck material. It would be placed at a position that is 180 degrees from the point at which the user determines to be a comfortable position to place the tool to begin the push of the material. It is attached as described in FIG. 22 It is to provide not only additional total gap closing capacity, but also to give a "locked" feel when the cam 39 makes contact with the material being pushed.

FIG. 21 is a top view of range cam 39 with the hole to accept the screw of FIG. 22. A front view of the cam should not be needed to appreciate the overall appearance.

FIG. 22 is the screw that holds the range cam 39 to threaded holes in the underside of lower handle 2. Holes are not show in drawings.

FIG. 23 is an enlarged view of the lower disk plate 17 with one of the five rows of multiple holes 13 (FIG. 7), shown for the purpose of detailing the use of magnetized parts. FIG. 23 is to show the magnetic insert 41 that is positioned just below the surface of the lower disk plate 17 and the magnetic washer 42 of nail 35. The insert 41 and washer 42 will have like magnetic poles so they will repel each other. The two purposes of the use of magnets here are: 1. Insert 42 would keep the nail from falling out when the tool is used upside down and it will hold the nail near its tip in a position ready for nailing. 2. The opposite force of the magnetism of insert 41 to that of magnetic washer 42 will keep the nail 35 in a raised position as mentioned, so it is ready for nailing, and also so the tip of nail 35 is not protruding beyond the bottom of lower disk 17 when the tool is not in use.

FIG. 24. shows the details of nail 35. It is made up of three parts. Double headed type nail 35, magnetic washer 42, and rubber washer 40. It has not been made apparent in any of the prior figures and reference numbers, that an appropriate sized screw and washer used in place of nail 35, will perform equally as well for the pivot point, when the tool is used on flat surfaces, such as plywood as shown in FIG. 17.

Figure 25:
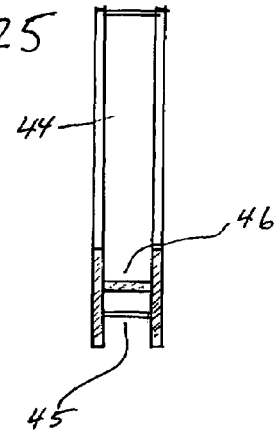
FIG. 25 Edge view of lock lever

FIG. 25 is an end view of cam nail assembly lock lever 44 which includes the off center axis roll pin 46 which passes through hole 49 in the cam nail shaft, and rotational stop pin 45 which stops the rotation of the lock lever handle at a horizontal position, thereby keeping the lever above the rim of lower handle disk attaching ring.

Figure 26:
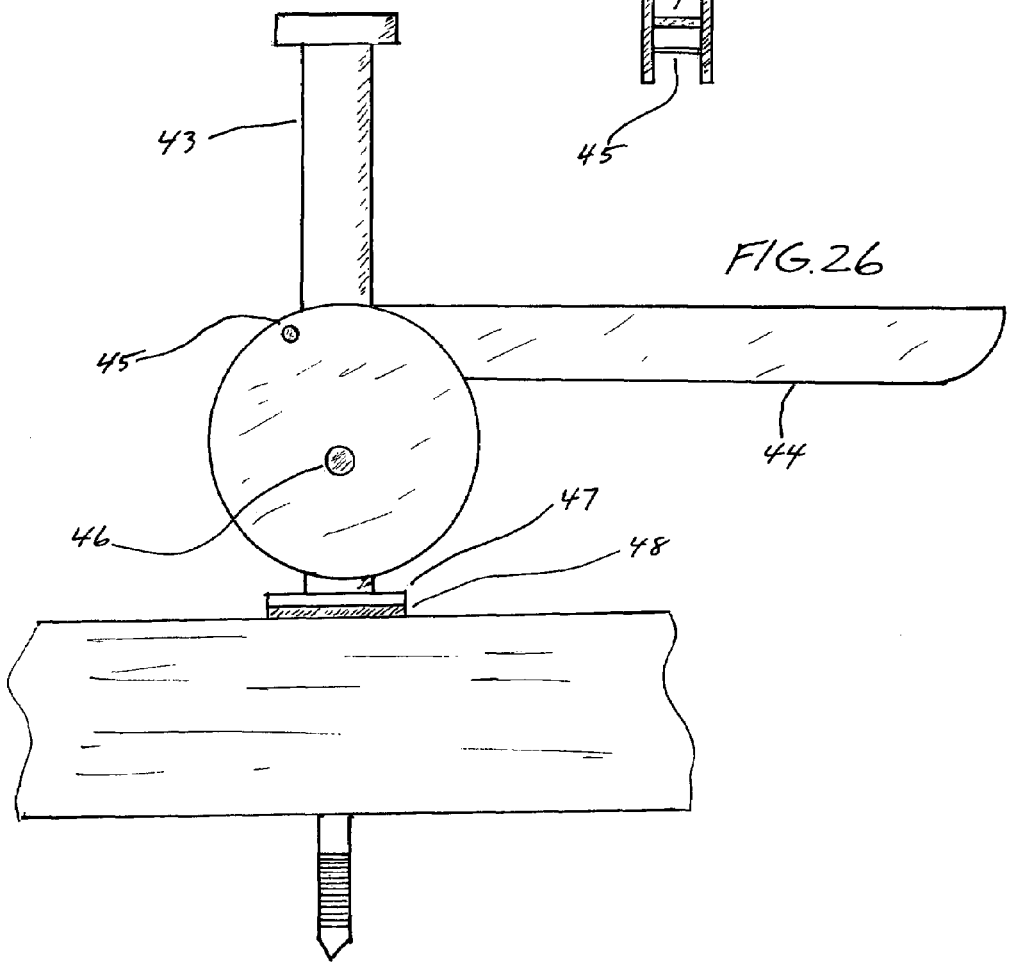
FIG. 26 Side view of the cam nail and lock lever assembly
Figure 27:
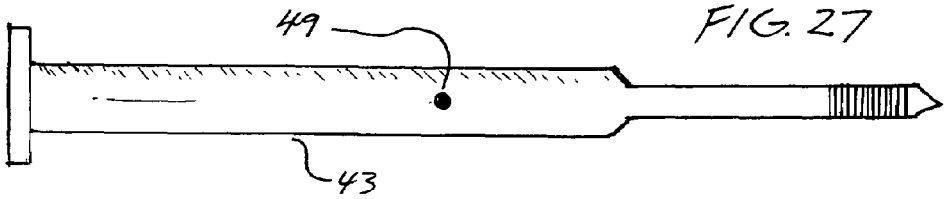
FIG. 27 Side view of cam nail

FIG. 26 is a side view of the cam nail assembly shown passing through a spoke of lower disk plate 17 of FIG. 8. The lower shank of the nail 43 would be embedded in wood (not shown). This fig. shows the nail in a unlocked position after it had been hammered down. The circular cam portion has not made contact with the metal washer 47. The nail stops when the beveled portion of the shank, as shown in FIG. 27, hits the washer, lifting the lever upward from this point will lock the tool assembly to the joist or plywood sub-floor, thereby holding the tool in a self maintained position. The roll pin 46 is off center of the true axis, causing circular portion of the lever to force into the washer 47. The cam nail assembly is used in place of magnetic nail 35 (FIGS. 23 and 24), and can be used with any wood sub-structure.

FIG. 27 is a side view of the cam nail 43 showing hole 49, which roll pin 46 passes through thereby holding the lever to the nail.

What I claim as my invention:

1. A device for pushing crooked boards into a straight condition for the purpose of fastening them to the sub structure of either two-by-four framing or plywood sub-floor said device comprising:

a handle with an elongated shaft and circular portion;

a disk assembly attached to said circular portion of said handle;

said disk assembly comprising an interior central portion with a center hub and a plurality of off centered aligned holes spaced around said center hub wherein said interior central portion has a plurality of elongated members with a plurality of holes radiating out from said center hub along each said elongated member extending from said center hub past said interior central portion connecting a circular portion of said disk assembly which is used as a means of leverage to rotate said disk assembly against a board, thereby forcing said board into position.

2. The device according to claim 1, wherein said disk assembly further comprising ridges on an outer perimeter of said disk assembly for gripping board edges.

3. The device according to claim 1, wherein said disk assembly further comprising threaded holes in said circular portion with bolt attaching protrusions to threaded holes in said circular portion of said handle.

4. A device for pushing crooked boards into a straight condition for the purpose of fastening them to the sub structure of either two-by-four framing or plywood sub-floor said device comprising:

a handle with an elongated shaft and circular portion;

a disk assembly attached to said circular portion of said handle;

said disk assembly comprising an interior central portion with a center hub and a plurality of off centered aligned holes spaced around said center hub wherein said interior central portion has a plurality of elongated members with a plurality of holes radiating out from said center along each said elongated member wherein said elongated member extending from said center hub past said interior central portion connecting to a circular portion of said disk assembly;

a plate circular plate including plurality of rollers which are attached off centered from a center of said circular plate with a plurality of stop pins wherein said circular plate has a pin and lock key which is used to lock the device into position.

5. The device according to claim 4, wherein said disk assembly further comprising ridges on an outer perimeter of said disk assembly for gripping board edges.

6. The device according to claim 4, wherein said disk assembly further comprising threaded holes in said circular portion with bolt attaching to protrusions with threaded holes in said circular portion of said handle.

7. The device according to claim 4, wherein said lock key includes an handle and cam surface which attaches to a clevis in said pin for rotational actuation of said handle.

8. The device according to claim 4, wherein said plurality of rollers is further comprising a bolt which said roller rotates around and spring that returns said roller to a pre-set position.

* * * * *